United States Patent [19]

Smith

[11] 4,074,409

[45] Feb. 21, 1978

[54] COMPOUND BOW STRING CHANGER

[76] Inventor: Jimmie T. Smith, 6737 E. 5th Place, Tulsa, Okla. 74112

[21] Appl. No.: 683,166

[22] Filed: May 4, 1976

[51] Int. Cl.[2] ..... B23P 19/02

[52] U.S. Cl. ..... 29/235; 124/23 R; 124/90

[58] Field of Search ..... 124/24 A, 24 R, 23 A, 124/23 R, 25, 1, 30, 90; 29/235, 200 B, 200 D, DIG. 3, DIG. 42, 427, 452; 24/115 R, 115 F, 115 H, 115 J, 115 D, 115 K; 254/149

[56] References Cited

U.S. PATENT DOCUMENTS

| | | | |
|---|---|---|---|
| 2,896,283 | 7/1959 | Huber | 24/115 X |
| 3,000,628 | 9/1961 | Kellogg | 124/23 R X |
| 3,055,655 | 9/1962 | Chelf | 124/23 R X |
| 3,082,756 | 3/1963 | Schall | 124/23 R |
| 3,207,145 | 9/1965 | Browning et al. | 124/23 R |
| 3,294,078 | 12/1966 | Allen | 124/23 R |
| 3,352,296 | 11/1967 | Burger | 124/23 R |
| 3,416,220 | 12/1968 | Wilson | 124/23 R |

*Primary Examiner*—Harland S. Skogquist
*Assistant Examiner*—William R. Browne
*Attorney, Agent, or Firm*—Head, Johnson & Chafin

[57] ABSTRACT

A bow string apparatus specifically designed for use with an archer's compound bow. The apparatus is provided with attachment brackets for attaching a pull cord to the bow cables between the opposite eccentric pulley wheels and the bow string attachment points. The pull cord utilizes a low friction sheath member and a sliding-locking bar for pulling tension on the bow and locking the bow in a compressed position while changing the bow string thereof.

8 Claims, 5 Drawing Figures

COMPOUND BOW STRING CHANGER

BACKGROUND OF THE INVENTION

1. Field of the Invention

The present invention relates to a bow stringing apparatus and more particularly, but not by way of limitation, to an apparatus for changing bow strings on an archer's compound bow.

2. Description of the Prior Art

With the development of the compound bow and the widespread use thereof, there has arisen the attendant problem of replacing defective or worn bow strings. The problem is present since a compound bow with its plurality of pulley wheels and attachment mechanism require adjustments or "tuning" after the bow is strung.

The compound bows utilize a typical fiber bow string which attaches to the ends of the pulley mounted cables thereof. If the bow string becomes worn or defective, the method of simply bending the bow and removing the old string, which is appropriate with conventional bows, completely throws the compound bow out of adjustment.

Therefore, when the new string is attached, the bow must be completely "tuned" again. For the relatively inexperienced user of the compound bow, this tuning operation is difficult and is expensive because he usually has to take his bow to a professional to get it finally readjusted or "tuned".

There have, in the past, been bow string apparatus for use with conventional bows in changing the string thereof. However, since the conventional bow is notched at the ends to hold the bow string the apparatuses were provided with means for attaching the stringing device to the extreme ends of the bow itself outside of the notches provided in the bow.

These devices are not usable with the compound bow since, at the extreme ends of the compound bow, there are eccentric wheels for giving such bows their mechanical advantage.

Further, such stringing devices as that taught in the patent to Allen, U.S. Pat. No. 3,294,078 issued in 1966, have the disadvantage of stringing the pull cord through a ring or the like which gives rise to high friction on the pull cord. This high friction results in added pull force being required to compress the bow and excessive pull cord wear.

SUMMARY OF THE INVENTION

The present invention provides a bow stringing apparatus which is particularly designed and constructed for permitting the changing of strings on the compound type bow and which is further designed to overcome the disadvantages present in the prior art devices.

As hereinbefore briefly set out, the present compound bows are normally provided with a pair of metal cables which are attached to the frame of the bow by adjustable attachment means, each cable being strung through two separate pivotally mounted pulleys and then through eccentric pulleys mounted at the opposite extremes of the bow frame. The ends of each of the cables are provided with bow string attachment devices whereby a typical bow string having loops at each end thereof are attached to the ends of the cable in a manner so that there is a constant tension load on the string.

As stated, the frame attachment points for the compound bow cable are adjustable and after the bow is fully strung these adjustments are utilized to "tune" the bow to the particular user. The string attachment means at the ends of each of the bow cables is normally a block, bead or the like that is attached to the end of the cable by swedging, soldered or other suitable means, each having an S-type hook for hooking to the loops on either end of the bow string.

The present invention utilizes a pull cord which is of a very strong twisted or braided nylon and having a diameter of approximately ⅛ inch. The length of the cord is somewhat longer than the bow string itself but not more than about 1½ times the length of the bow string. One end of the pull cord is firmly secured to a first hook member which has a general cross-sectional J-shape, the hook member has a slot which may be V-shaped at the short leg of the hook which is sized to accept the compound bow cable therein but small enough to prevent the bow string attachment device from being able to pass through the slot. The long leg of the J-shaped hook member is secured to one end of the pull cord. The opposite end of the pull cord is secured to one of an elongated slide bar which is normally approximately six inches in length. The opposite end of the slide bar is provided with a bore transversely therethrough, the diameter of the bore being substantially equal to the diameter of the pull cord which will allow the pull cord to be slidingly passed therethrough.

There is a second substantially J-shaped hook member which is very similar in construction to the first mentioned hook member and has a similar slot member in one end thereof, the other end thereof however being provided with a rotatable sheath for purposes that will be hereinafter set forth.

As stated before, one end of the pull cord is securely attached to the first mentioned hook member. The other end is passed through the bore in one end of the elongated bar, through the sheave of the second hook member with the end thereof being firmly attached to the opposite end of the elongated bar.

When it is desired to change the bow string on the compound bow, the two hook members of the stringing apparatus are attached to the opposite compound bow cable ends between the eccentric pulley wheels and the bow string attachment means. This attachment prevents any interference with the eccentric pulleys during the string changing operation. The elongated bar is then pivoted to a position so that the bore in one end thereof is aligned parallel to the bow string, thereby permitting sliding of the pull cord through the said bore.

Pressure is then applied to the elongated bore in the direction away from the sheaved hook member which in turn applies tension to the pull cord. This pressure is continued which in effect is pulling the cable ends together, thereby releasing tension on the bow string and compressing the bow. When the bow is compressed to an extent sufficient to completely relax the tension in the bow string itself, the elongated rod is rotated so that it is substantially parallel to the bow string which causes the bore in one end of the elongated bar to be oriented to be substantially perpendicular to the bow string line. This causes two sharp bends in the pull cord at the point where it is passed through the bore in the elongated bar, thus locking the bar in position and keeping the bow in a compressed position.

The bow string may then be easily removed and replaced with a new or different bow string. After the new bow string is secured to the string attachment means at the end of each cable, pressure is released on the pull cord by pivoting the elongated bar to a position perpendicular to that of the bow string and releasing the tension off the pull cord and back onto the new replaced bow string.

By utilizing the above described method and apparatus, the bow string is replaced without ever relieving tension on the compound bow string cables thereby preventing the requirement of major adjustments or tuning of the bow. It is also readily seen that this has been accomplished without any interference with the eccentric pulleys located at the ends of the bow frame. It is also noted that the utilization of the rotating sheath in connection with one of the hook members prevents any rubbing or frictional contact with the pull cord itself which prevents excessive wear of the pull cord and makes the compression operation easier due to reduction of friction. Further, since the only major frictional contact with the pull cord is through the bore in the elongated bar, this friction is reduced to a minimum by the orientation of the bar and when locked in place the friction is totally in the nature of static friction, which again reduces any excessive wear on the cord itself.

DESCRIPTION OF THE DRAWINGS

Other and further advantageous features of the present invention will hereinafter more fully appear in connection with the detailed description of the drawings, in which.

DESCRIPTION OF THE PREFERRED EMBODIMENT

Figure 1:
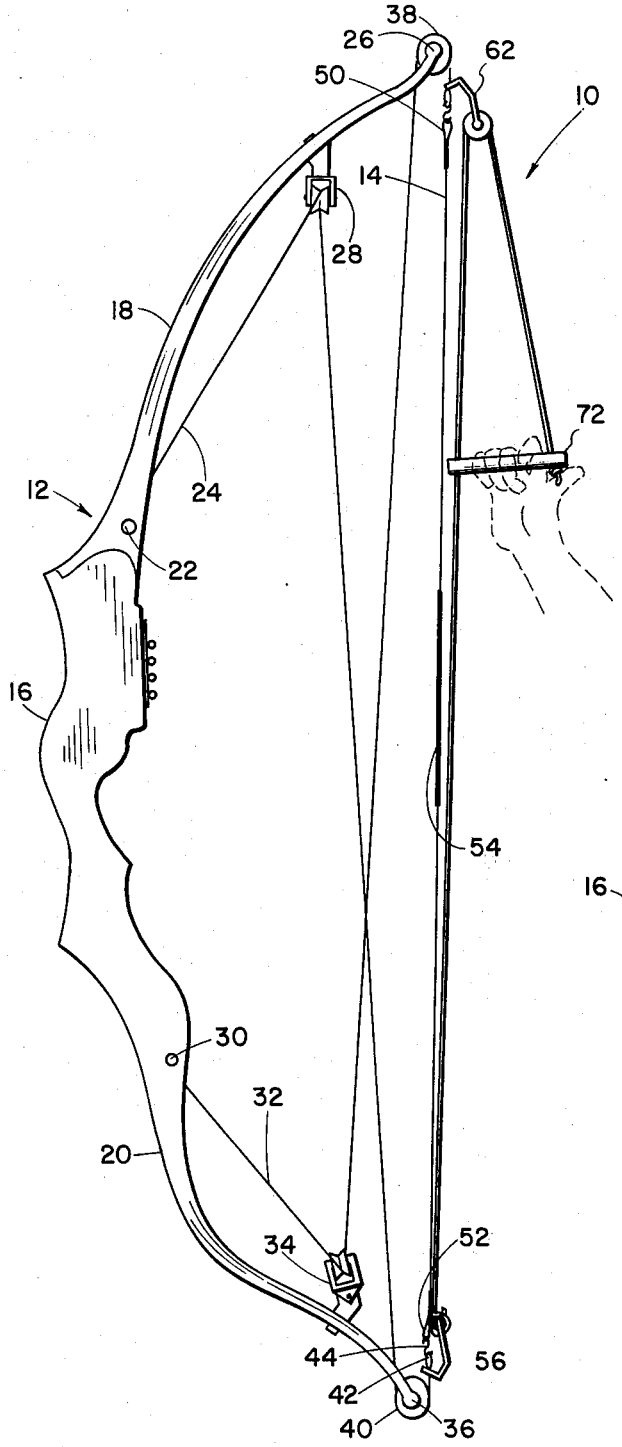
FIG. 1 is an elevational side view of a compound bow having attached, a bow stringing device embodying the present invention.

Referring to the drawings in detail, reference character 10 generally indicated a bow string apparatus for use with a compound bow 12 for changing the bow string 14 thereof.

The bow 12 normally is provided with a frame member having handle 16 and tapered oppositely directed frame members 18 and 20. The frame member 18 is provided with a rotatable adjustment pin 22 having one end of a wound metal cable 24 attached thereto and wrapped therearound. Between the pin 22 and the outer end 26 of the frame member 18 is a pivotally mounted pulley 28 over which the cable 24 is passed.

Likewise, the frame member 20 is provided with a similar rotating pin 30 having a second cable member 32 attached thereto and wrapped therearound. There is likewise a pivotally mounted pulley member 34 which is attached to the frame between the pin member 30 and the outer end 36 of the frame 20 over which the cable 32 is passed.

The outer end 26 of the frame 18 is provided with an eccentric mounted pulley wheel 38 and an oppositely disposed similar eccentric mounted pulley 40 is attached to the opposite end 36 of the bow. The cable member 24 after being passed over the pivotal pulley 28 is then passed over the eccentric wheel 40 and terminates with an enlarged bead member 42. The bead member 42 is provided with an S-shaped hook member 44 for attaching to one end of the bow string 14 as will be hereinafter set forth.

The cable member 32 after being passed through the pivotal pulley member 34 is passed over the eccentric wheel 38 and likewise terminates with an enlarged bead member 46 and associated S-shaped hook member 48 for attaching to the opposite end of the bow string as will be hereinafter set forth.

The bow string 14 is normally of the strong fiberlike material which is provided with a loop 50 at one end thereof for attachment to the S-shaped hook member 48 and a second loop 52 which is attachable to the opposite S-shaped hook member 44. The bow string 14 is also provided with an enlarged wrapped mid-portion 54 for receiving the notch of an arrow (now shown).

When the bow is completely fitted with cable and string as shown in FIG. 1, the bow is tuned so that particular length of string and archer's need by means of rotating the cable pin members 22 and 30 so that the bow is in the proper state of compression when fitted with the proper string 14.

The bow string apparatus or device 10 generally comprises a hook member 56 which may be constructed of a flat plate having a substantial J-shaped cross-section, the elongated portion of the J-plate having an attachment hole 58 therethrough. The opposite curved end of the J-shaped plate is provided with a notch 60 having an opening of sufficient width to receive the cable 24 therein, but being sufficiently small as to not allow the bead member 42 at the cable 24 to pass therethrough. The open end of the notch 60 has an enlarged window 61 for a purpose that will be set forth.

The apparatus 10 also comprises a similar hook member 62 having a J-shaped configuration, the smaller curved portion having a slot or notch 64 therein which is sufficiently wide to receive the cable member 32 therethrough but sufficiently small to not allow the bead member 46 to pass therethrough. The elongated end of the J-shaped hook 62 is provided with an enlarged opening 66 therein for receiving a pulley member or sheave 68. The sheave 68 is rotatably mounted to the hook member 62 by means of a pin member 70. The open end of the notch 64 has an enlarged window 65 for a purpose that will be set forth.

The apparatus 10 also comprises an elongated bar 72 having a first transverse bore 74 near one end thereof and oppositely disposed transverse bore 76 adjacent the opposite end thereof. The device further comprises an elongated flexible pull cord 78 which is normally constructed of a twisted or braided nylon material and having a diameter substantially equal to the diameter of the bores 74 and 76 such that said pull cord 78 may be slipped through said bores so long as the bores 76 and 74 are substantially perpendicular to the orientation of the pull cord 78. The length of the pull cord 78 should be somewhat longer than the bow string 14 but in most instances should not be longer than one and one-half times the length of said bow string 14.

One end of the pull cord 78 is attached to the hook member 56 by means of the attachment hole 58, and can be attached simply by the knot 80 as shown in the drawings. The opposite end of the pull cord 78 is slidingly passed through the bore 76 on one end of the elongated bar 72, over the rotatable sheave 68 and through the bore 74 at the opposite end of the elongated bar 72. The end of the pull cord 78 may be attached at the bore 74 by another simple knot 82 as shown in the drawings.

The method for changing the bow string 14 by use of the apparatus 10 is described by the following steps:

Step 1 — attach the hook member 56 to the cable 24 above the bead member 42.

Step 2 — attach the second hook member 62 to the cable 32 above the bead 46.

Figure 2:
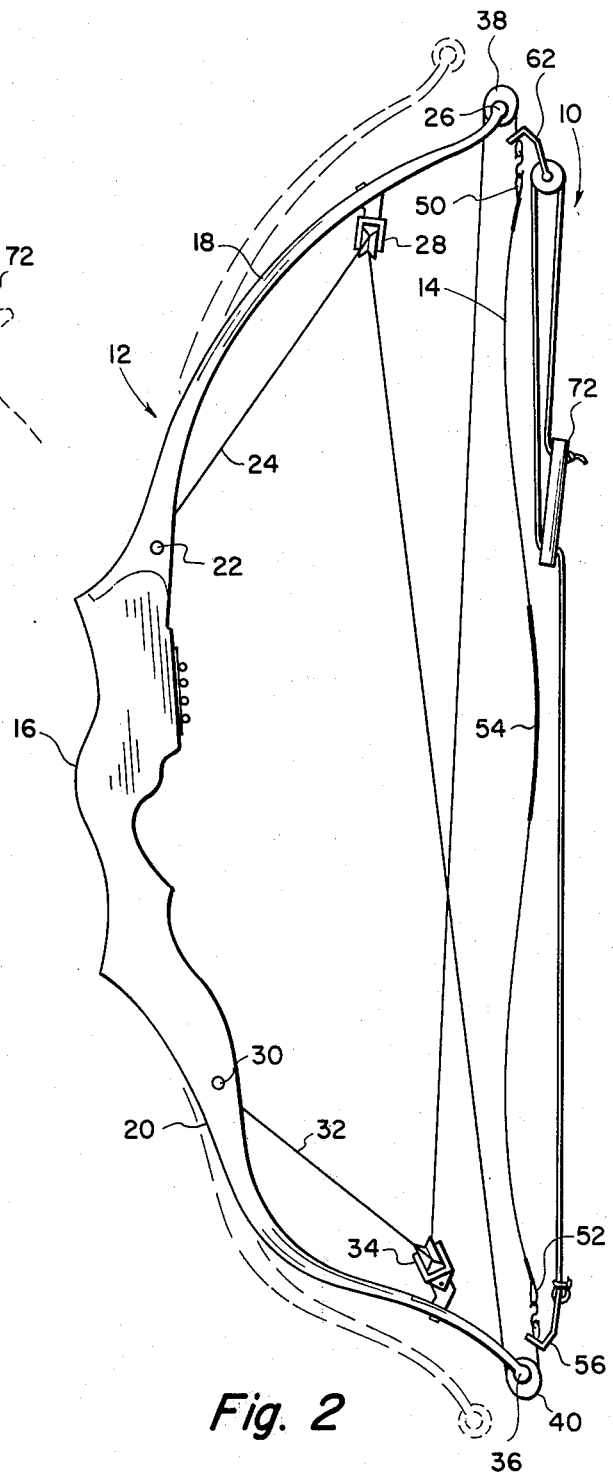
FIG. 2 is an elevational side view of the bow of FIG. 1 after having been compressed by the bow stringing apparatus of FIG. 1

Step 3 — orient the elongated bar 72 perpendicular to the bow string and pull the bar along the pull cord 78 in a direction away from the hook member 62 until the bow is compressed thereby relaxing the bow string 14 as shown in FIG. 2.

Step 4 — orient the elongated bar 72 to a position substantially parallel to the bow string 14 thereby locking the stringing apparatus 10 in position as shown in FIG. 2 which in effect locks the bow frame in a compressed state as shown in FIG. 1 and as indicated by the dashed lines of FIG. 2.

Step 5 — remove and replace bow string 14 from the S-shaped support hooks 44 and 48.

Step 6 — replace the bow string 14 with a new string attached into the loops thereof to the S-shaped support hooks 44 and 48.

Step 7 — reorient the elongated bar 72 perpendicular to the bow string and relax the tension thereon until the tension is transferred to the bow string 14.

Step 8 — remove the bow string apparatus 10.

It is noted that Steps 1 and 2 may be interchanged and naturally the bow stringing apparatus may be hooked oppositely to the configuration shown in FIGS. 1 and 2.

Figure 4:
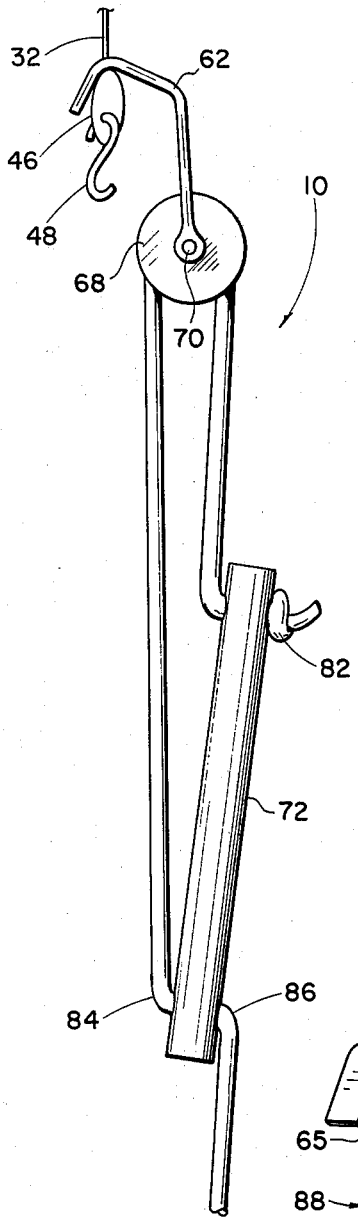
FIG. 4 is an elevational detailed view of the bow stringing apparatus depicted in FIG. 2 in a locked mode.
Figure 4:
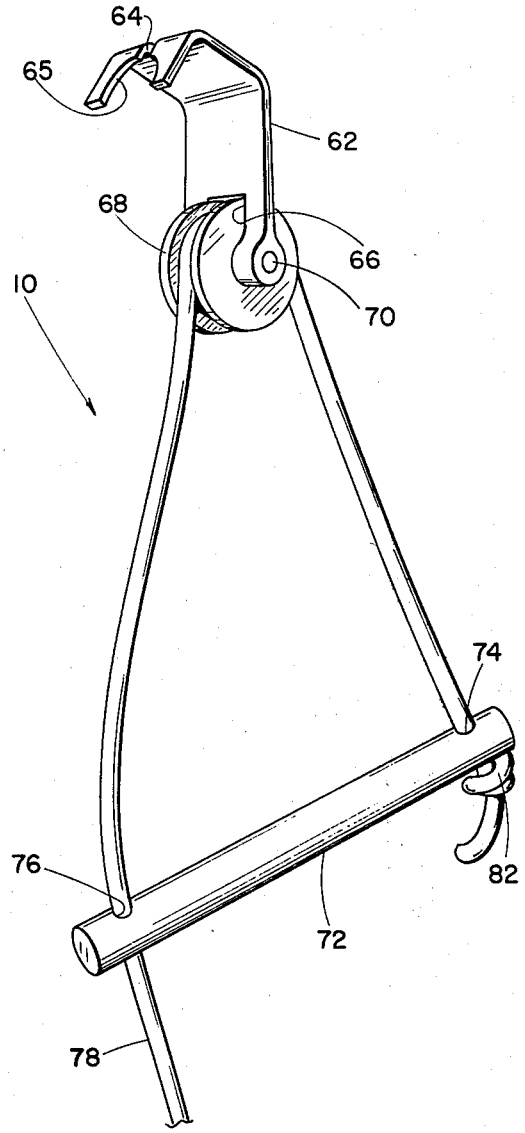
Figure 4:
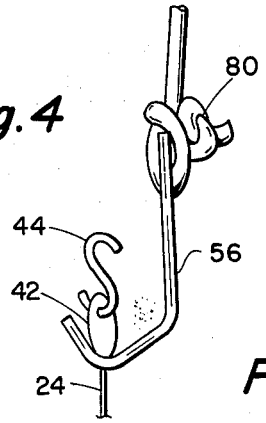

It is apparent by utilizing a bore size 76 which is compatible with the diameter of the pull cord 78, that when tension is pulled on the bow stringing apparatus and the elongated bar 72 is oriented parallel to the direction of that tension as shown in FIG. 2 and FIG. 4, that the pull cord 78 is forced to make two substantially right angle bends at 84 anf 86 which creates static friction at that point to the extent that the pull cord will be prohibited from sliding through the bore 76 thereby locking the pull cord apparatus in a state of tension.

Figure 5:
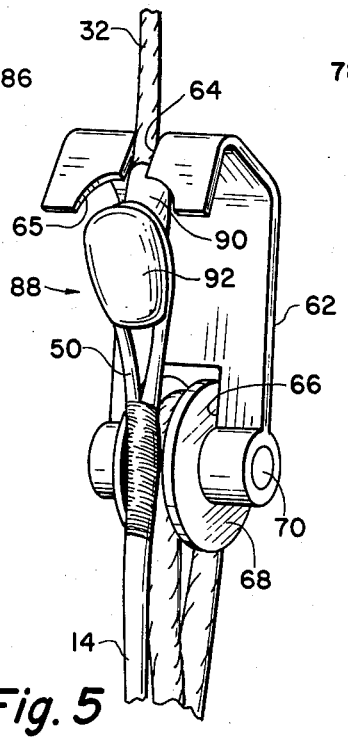
FIG. 5 is a prospective detailed view depicting an alternate string attachment means.
Figure 3:
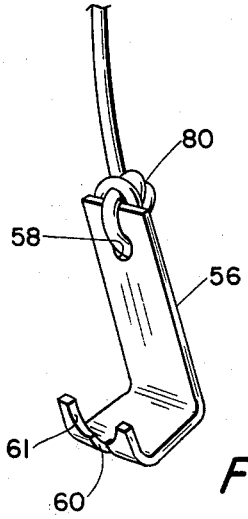
FIG. 3 is a perspective view of the bow stringing apparatus of FIG. 1.

Referring to FIG. 5, the end of the cable 32 is provided with an alternate type string attachment means 88. The string attachment means 88 comprises a bead portion 90 which is attached to the end of the cable 32 and having an enlarged offset portion 92 for supporting the loop 50 of the string 14.

The enlarged window 65 of the hook member 62 serves the dual purposes of guiding the cable 32 into the slot 64 and for allowing the end of the hook member 64 to clear the enlarged portion 92 of the attachment means 88.

Whereas, the present invention has been described in particular relation to the drawings attached hereto, it is obvious that other and further modifications apart from those shown are suggested herein may be made within the spirit and scope of the invention.

What is claimed is:

1. A bow stringing apparatus comprising:

a. an elongated flexible pull cord being adjustable in length to provide a cord length longer than the distance between cable ends of a compound bow when a bow is strung but shorter than twice said distance and having a substantially uniform diameter;

b. a first cable attachment means removably attachable to one cable end between an associated bow string support and its associated eccentric pulley;

c. a second cable attachment means removably attachable to an opposite cable end between an associated bow string support means and its associated eccentric pulley, a rotatable sheave carried by the second cable attachment means;

d. an elongated bar having cord attachment means at one end and a transverse bore therethrough spaced from the cord attachment means, said bore being of a diameter substantially equal to that of the pull cord;

whereby one end of the pull cord being secured to the first cable attachment means, the other end being slidably disposed through said transverse bore in the elongated bar, passed around the rotatable sheave and secured to the elongated bar cord attachment means.

2. A bow stringing apparatus as set forth in claim 1 wherein the first cable attachment means comprises an elongated plate member having a hook portion at one end thereof, the hook portion having an open slot therein, said slot having a width sufficient to receive a compound bow cable end therein, but smaller than a bow string support, said pull cord being attached to the opposite end of said elongated plate.

3. A bow stringing apparatus as set forth in claim 2 wherein the open slot has an enlarged opening at the open end thereof.

4. A bow stringing apparatus as set forth in claim 1 wherein the second attachment means comprises an elongated plate member having a hook portion at one end thereof, the hook portion having an open slot therein, said slot having width sufficient to receive a compound bow cable end therein and smaller than a bow string support, the other end of the plate member having a U-shaped slot for carrying said rotating sheave therein.

5. A bow stringing apparatus as set forth in claim 4 wherein the open slot has an enlarged opening at the open end thereof.

6. A bow stringing apparatus as set forth in claim 1 wherein the flexible pull cord is of a braided nylon construction.

7. A method for changing a bow string of a compound bow by means of a tent cord type tightening apparatus and comprising the steps of;

a. attaching a first attachment means to one compound bow cable end;

b. attaching a second attachment means to an opposite compound bow cable end;

c. orienting a pull bar perpendicular to a bow string of a compound bow and pulling the pull bar along a pull cord until a compound bow is compressed thereby relaxing a bow string;

d. orienting the bar substantially parallel to a bow string thereby locking a bow under compression;

e. removing and replacing a bow string from a bow string support;

f. reorienting the bar perpendicular to a bow string and relaxing tension thereby transferring tension to a bow string;

g. removing the tightening apparatus.

8. A bow string apparatus comprising;

a. an elongated flexible pull cord being adjustable in length to provide a cord length longer than the distance between cable ends of a compound bow when a bow is strung but shorter than twice said distance and having a substantially uniform diameter;

b. a first cable attachment means removably attachable to one cable end between an associated bow string support and its associated eccentric pulley;

c. a second cable attachment means removably attachable to the opposite cable end between an associated bow string support means and its associated eccentric pulley, means for movably receiving the pull cord therearound carried by the second cable attachment means;

d. an elongated bar having cord attachment means at one end and a transverse bore therethrough spaced from the cord attachment means, said bore being of a diameter substantially equal to that of the pull cord;

whereby one end of the pull cord is secured to the first cable attachment means, the other end being slidably disposed through said transverse bore in the elongated bar, passed around the pull cord receiving means and secured to the elongated bar cord attachment means.

* * * * *